US007194833B1

(12) United States Patent
Curry

(10) Patent No.: US 7,194,833 B1
(45) Date of Patent: Mar. 27, 2007

(54) FIRING MECHANISM FOR SEMI-AUTOMATIC PISTOLS

(75) Inventor: Brett Curry, Chicopee, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 10/775,611

(22) Filed: Feb. 10, 2004

Related U.S. Application Data

(60) Provisional application No. 60/446,123, filed on Feb. 10, 2003.

(51) Int. Cl.
*F41A 3/00* (2006.01)

(52) U.S. Cl. ..... 42/14; 42/16; 42/69.01; 42/69.02

(58) Field of Classification Search ..... 42/14, 42/15, 16, 69.01, 69.02, 69.03; 89/27.11
See application file for complete search history.

(56) References Cited

U.S. PATENT DOCUMENTS 5,386,659 A 2/1995 Vaid et al.

5,806,225 A * 9/1998 Gardner et al. ..... 42/69.02

* cited by examiner

*Primary Examiner*—J. Woodrow Eldred
(74) *Attorney, Agent, or Firm*—McCormick, Paulding & Huber LLP

(57) ABSTRACT

A firing mechanism for a firing pin striker operated semi-automatic handgun that includes a sear, a sear block housing, and a pivot arm. The sear is attached to the pivot arm and includes two angled surfaces and an edge portion for controlling the firing pin. The edge portion abuttingly engages an extension of the firing pin adapted to be in planar movement with the edge portion of the sear. The pivot arm and sear move together in an arcuate path about the pin in response to trigger firing movement. Unlike prior art firing mechanisms, the sear does not move vertically along an axis perpendicular to the bore of the handgun. The arcuate movement of the pivot arm causes the edge portion of the sear to disengage from the firing pin. The angled surfaces of the sear allow the firing pin extension to pass over the sear discharging the firearm.

20 Claims, 4 Drawing Sheets

FIRING MECHANISM FOR SEMI-AUTOMATIC PISTOLS

CROSS REFERENCE TO RELATED APPLICATIONS

This application claims the benefit of U.S. Provisional Patent Application Ser. No. 60/446,123 filed on Feb. 10, 2003, entitled "AN IMPROVED FIRING MECHANISM FOR SEMI-AUTOMATIC PISTOLS," herein incorporated by reference in its entirety.

FIELD OF THE INVENTION

The present invention relates generally to a firing mechanism for a semiautomatic pistol or handgun which employs a firing pin striker mechanism and more particularly to a firing mechanism with a simplified sear block assembly.

BACKGROUND OF THE INVENTION

One type of firing mechanism commonly used in semi-automatic handguns includes a hammer which is pivotable from a rearward cocked position to a forward position for impacting the firing pin. A sear releasably retains the hammer in its cocked position with the hammer spring or main spring in compression. When the trigger is actuated, the sear is moved to release the hammer that is moved by the stored energy of the main spring, to strike the firing pin which is thereby driven forward to fire a chambered round. The principal drawback of this type of mechanism is that it includes numerous parts and is relatively complex and expensive to manufacture.

Another common configuration is disclosed in U.S. Pat. No. 3,857,325 to Thomas, which is hereby incorporated by reference in its entirety, wherein a striker-type firing pin is utilized in lieu of a pivotable hammer. In past embodiments of this mechanism, the firing pin was actuated by an action of a trigger bar engaged to a trigger which moved the firing pin axially along the length of the bore of the barrel causing the sear to rotate about its pivot point. As the sear rotated, a spring was compressed as the sear block cam engaging member engaged a cam surface on the sear. This caused the upper sear portion to be displaced downward relative to the firing pin. Therefore, during the movement of the trigger backwards, the rearward movement of the firing pin corresponded with a downward movement of the upper sear element gradually lessening the amount of surface of the sear abutment in contact with the firing pin leg until the firing pin leg was free of the sear and the firing pin moved forward urged on by the spring and strike the rear of the casing and discharge the round. This embodiment of sear block was characterized by two elements, the sear and a pivot arm, which were moveable relative to one another along an axis as depicted in U.S. Pat. No. 5,386,659, which is hereby incorporated by reference in its entirety. There was also a spring urging the upper element to remain at its fully displaced position.

Consequently, this required, in certain embodiments, a land in the sear block casing which would have prevented the upper sear element from moving along an axis perpendicular to the bore axis, and hence, eliminate the overlap and contact area of the abutment with the leg of the firing pin, such that only when the sear was rotated almost its full extent, was it capable of being displaced along the perpendicular sear axis. In addition, there is a requirement of a second surface formed in the sear block housing which caused an element to cam along its surface creating a force to oppose that of the sear block spring and thereby urging the upper seal element downward along the perpendicular axis and reducing the overlap between the abutment and the leg of the firing pin.

In later embodiments, the inner land which prevents the movement of the upper sear element along the perpendicular axis was eliminated and the sear spring was increased in force to ensure retention of the firing pin.

The present invention provides a simplified sear assembly that is less expensive to manufacture as the number of components and surfaces are reduced. Additionally, the present invention provides an improved trigger pull and trigger movement over the prior art.

SUMMARY OF THE INVENTION

An embodiment of the present invention is a firing mechanism for a semi-automatic pistol having a frame, a slide reciprocally mounted on the frame, a barrel, a firing pin and a trigger. The firing mechanism includes a housing mounted within the frame of the pistol and a pivot arm assembly located within the housing. The pivot arm assembly includes a pivot arm frame that has laterally spaced side walls, an upper portion, a lower portion and an inner cavity disposed between the side walls. The lower portion of the pivot arm frame is pivotally attached to the housing such that the pivot arm frame may selectively pivot about a pivot point in a substantially arcuate path between a forward position and a rearward position relative to the front and rear of the pistol. The firing mechanism further includes a sear pivotally attached to the upper portion of the pivot arm frame. The sear selectively pivoting about a pivot point in a substantially arcuate path between a first position and a second position. The firing mechanism also includes a spring mechanism operatively connected to said sear exerting a biasing force on the sear urging the sear toward said first position.

DETAILED DESCRIPTION OF THE PREFERRED EMBODIMENT

Figure 1:
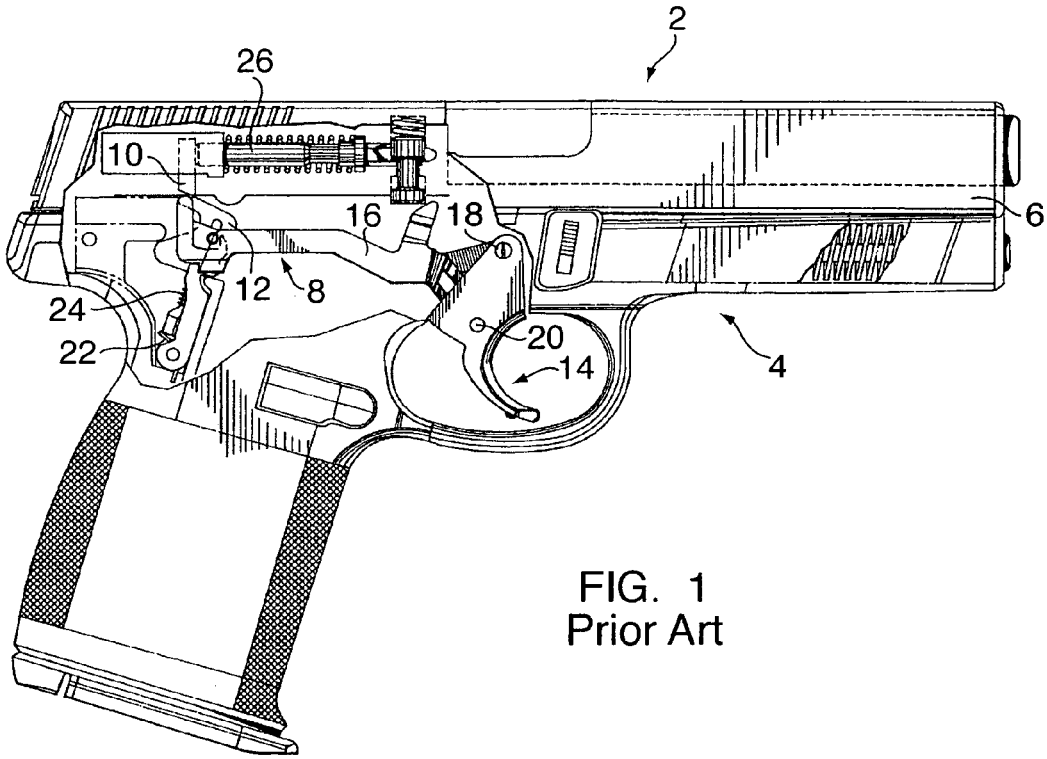
FIG. 1 Prior Art
FIG. 1 is an elevational view of a prior art semiautomatic handgun embodying the prior art firing mechanism with portions cut away to expose the firing mechanism.

Referring to FIG. 1, a prior art semiautomatic pistol or handgun 2 is shown and generally comprises a high impact polymeric frame 4, slide 6 and a firing mechanism 8. The prior art firing mechanism is a striker-type firing pin mechanism and is depicted in U.S. Pat. No. 5,386,659, which is hereby incorporated by reference in its entirety. The striker or firing pin 26 includes a depending leg 10, which selectively engages a sear 12 of the firing mechanism.

Figure 2:
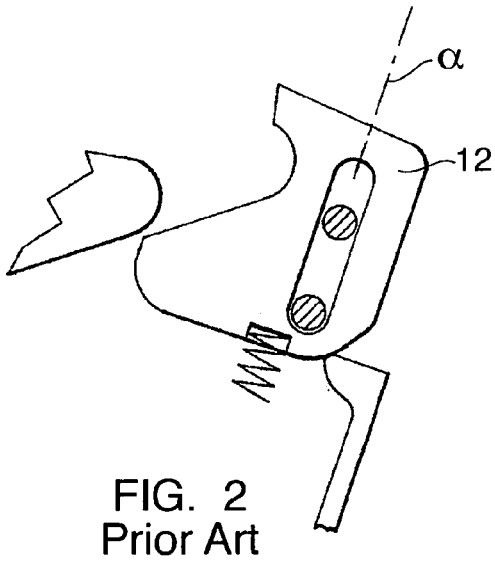
FIG. 2 Prior Art
FIG. 2 is an enlarged view of a prior art sear and a cooperating portion of the housing.
Figure 3:
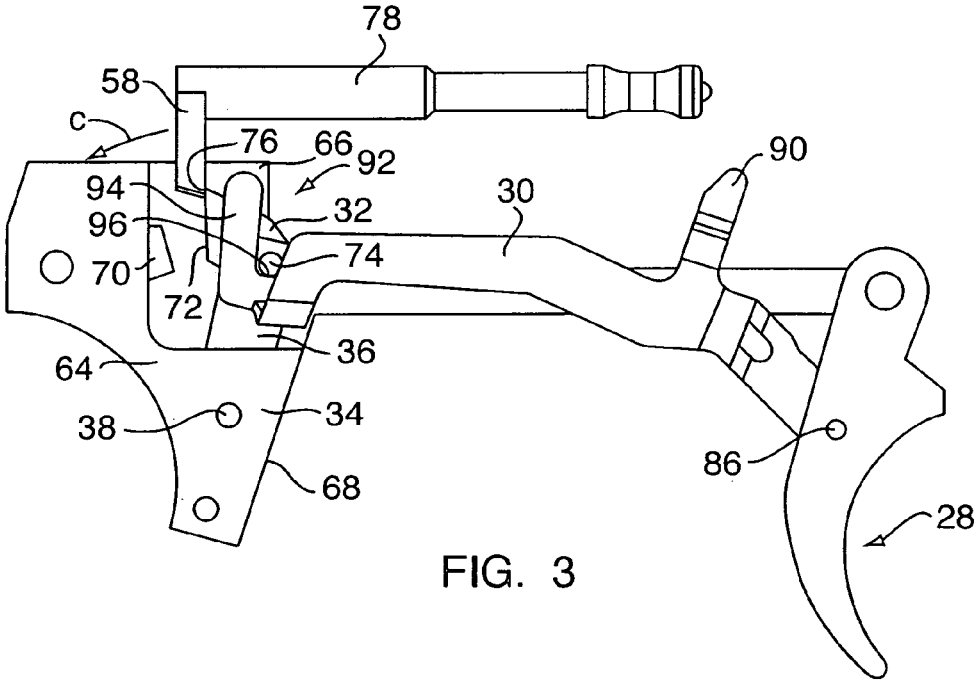
FIG. 3 is a cross-sectional view of a sear block assembly of a firing mechanism provided according to the present invention.
Figure 4:
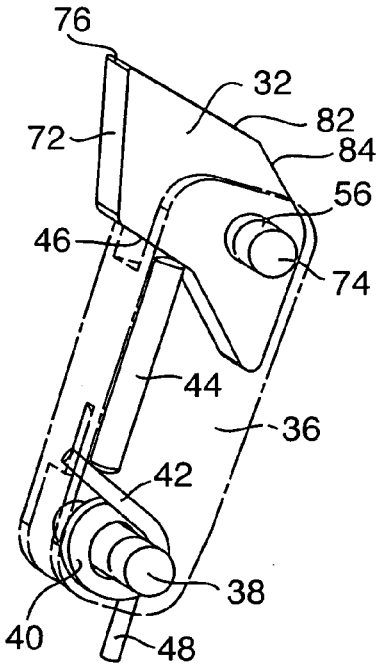
FIG. 4 is a perspective cut-away of a pivot arm of the present invention illustrating the interaction of the sear, pivot pin, sear spring, and actuation arm.

The prior art firing mechanism 8 further includes a trigger 14 that pivots to move a trigger bar 16 longitudinally in response to operation of the trigger. The trigger may be of unitary construction, as shown, or of a two-piece articulated construction as depicted in U.S. Pat. No. D371591, which is hereby incorporated by reference in its entirety. In either case, when one actuates the trigger, it will move rearward about the pivot pin 18 and its pivotable movement will be transmitted to the trigger bar by a pin 20 (FIG. 2). Movement of the trigger bar 16 will, in turn, move the sear sufficiently to cause the gun 2 to be fired. Referring to FIGS. 3 and 4, upon firing, recoil of the gun will cause the trigger bar 16 to be deflected downwardly and be disconnected from the sear 12 to enable a sear spring 22 and coil spring 24 to reposition the sear to its forward position for the next firing cycle.

As shown in FIG. 2, with this type of prior art firing mechanism, the sear 12 is displaced vertically downward along an axis a substantially perpendicular to the bore of the gun. The vertical displacement of the sear causes an edge portion of the sear to disengage from a depending leg of the firing pin discharging the gun.

Referring now to FIG. 3, a firing mechanism provided by the present invention also comprises a trigger 28 that pivots to move a trigger bar 30 longitudinally in response to operation of the trigger. As with the prior art mechanism, movement of the trigger bar 30 moves the sear 32 sufficiently to release the firing pin spring and cause the gun to be fired. However, as discussed in greater detail hereinafter, the sear of the present invention functions differently from the prior art sear.

Referring now to FIG. 4, the sear block assembly of the present invention comprises a sear 32, a sear block housing 34, and a pivot arm frame 36 adapted to pivot about a pivot pin 38. The pivot pin has a sear spring disposed about it. As shown in FIG. 4, the sear spring 40 has a central loop portion and a pair of radially extending outer end portions or legs. One of the legs 42 engages an actuation rod 44 which in turn engages the bottom surface 46 of the sear. The upward tension or biasing force of the spring forces the actuation rod 44 upward holding the sear in an first or upright position. The other leg 48 engages a front wall of the sear block housing. The sear spring 40 urges the pivot arm frame 36 to its forward position, relative to the front and rear of the pistol, and opposes the direction of the trigger pull when firing the gun.

Figure 5:
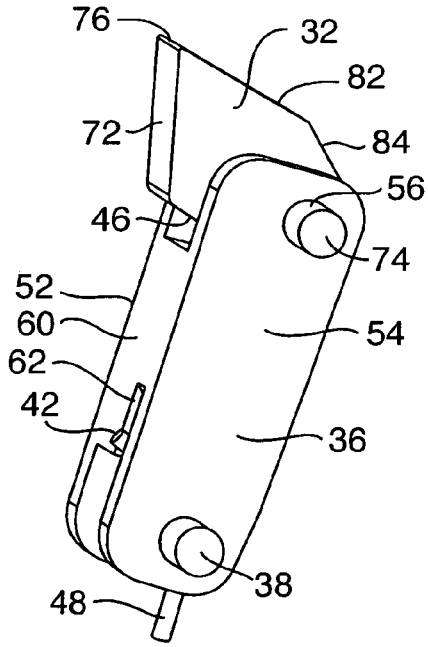
FIG. 5 is a perspective view on an enlarged scale of a sear of the present invention.
Figure 9:
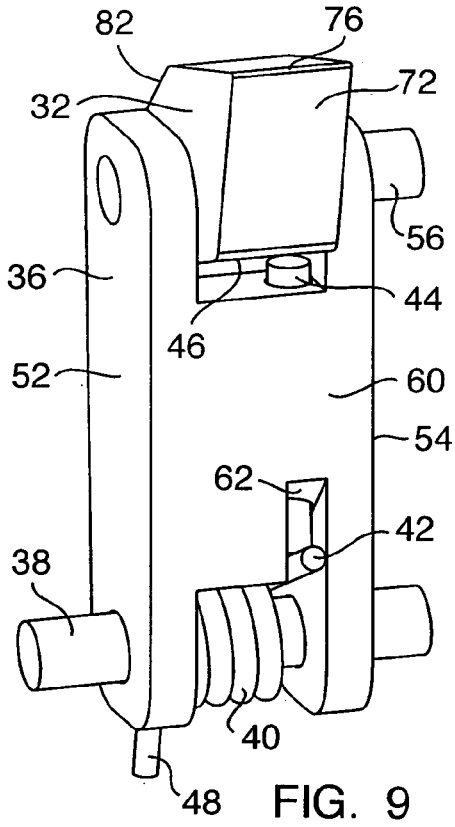
FIG. 9 is a perspective view on an enlarged scale of the sear of the present invention illustrating the engagement of the sear, actuation rod, and leg of the coil spring.

Referring now to FIGS. 5 and 9, the pivot arm frame 36 includes side walls 52 and 54. The sear 32 is secured to the side walls of the pivot arm frame by a pin 56 creating a pivot point. The sear pivots about the pin 56 in an arcuate rearward path when the firing pin is in front of the sear and must pass by the sear in a rearward direction to return to its ready to fire position. When the firing pin leg passes by the sear, it exerts a downward force on the sear causing the sear to pivot downward allowing the firing pin to pass the sear. Once the firing pin has passed the sear the sear returns to its normal or first position through the upward force exerted by the sear spring 40 and pivot arm frame pin 38. As shown in FIG. 3, once the sear returns to its first position, the edge of the sear is once again in contact with the leg of the firing pin and the gun is ready for use.

Figure 6:
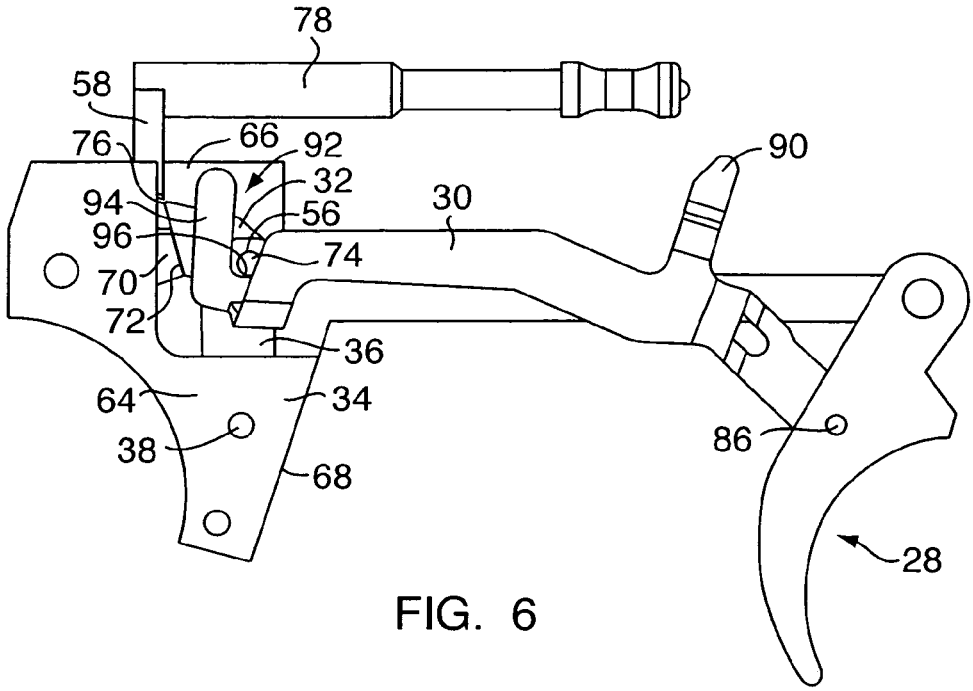
FIG. 6 is a cross-sectional view of the sear block assembly of FIG. 3 with the trigger depressed.

Referring back to FIG. 5, the pivot arm frame 36 also includes a rear wall 60 which includes a slot 62 within which is the leg 42 of the sear spring. The slot 62 limits the upward travel the leg and, in turn, of the sear 32. The upward limit or stop of the slot positions the rearward or control edge 76 of the sear such that it engages the firing pin leg 58. As shown in FIG. 6, the sear block housing 34 includes side walls 64, 66 and a front wall 68. The forward movement of the pivot arm is limited by forward edges of the side walls of the pivot arm frame 36 contacting the inner surface of the front wall 68 of the sear block housing. Rearward movement of the pivot arm is limited by a stop 70 in the sear block housing. The stop is shaped to abuttingly engage the rear surface 72 of the sear.

The sear pin 56 is secured at one side wall 66 of the sear block housing and extends through a hole in the other side wall 64. The pin includes a terminal end portion 74 that extends outwardly of the plane of the side wall 66.

The pivot arm frame 36 is fitted within stationary sear block housing 34 and secured thereto by the pivot pin 38 which is fitted into holes in the lower end portions of side walls 64 and 66 of the housing 34. The pivot pin extends from the sear housing through bores in side walls of the pivot arm. The sear housing is fitted into the handgun frame as depicted in prior art. The sear housing may be removed from the handgun frame as well. In a preferred embodiment, the sear housing is a molded unitary component of a lightweight, high impact polymer, such as Nylon 66 impregnated with 30% by weight glass fibers and 13% by weight TEFLON.® particles uniformly dispersed throughout the polymer with the result being that the sear housing will have a low coefficient of friction and inherent lubricity characteristics.

The sear 32 and pivot arm frame 36 together form a third class lever having its fulcrum or pivot point at pivot pin 56. The input force is applied by the trigger bar 30 and the output, in the form of work, is the angular motion at control edge 76 of the sear in response to rearward movement of the trigger bar, from a forward or first position, as shown in FIG. 3 to a rear or second position, as shown in FIG. 6. The control edge 76 of the sear is adapted to engage the firing pin leg 58 that extends from the firing pin 78 so that as it is moved rearwardly, the sear will cause the firing pin spring to be compressed.

Figure 7:
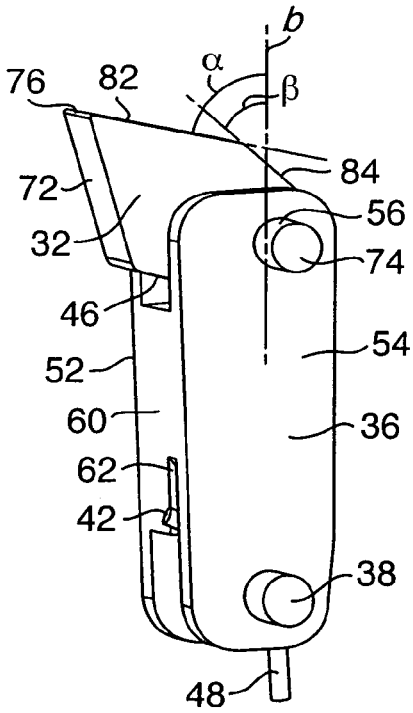
FIG. 7 is a perspective view on an enlarged scale of the sear of the present invention illustrating angled first and second surfaces of the sear.

Referring to FIG. 5, the sear 32 has a first cam surface 82 and a second surface 84 located at the upper outer perimeter of the pivot arm. The rear edge or control edge 76 of the first cam surface abuttingly engages the leg of the firing pin 58 when the trigger is at full release. The second surface 84 is adjacent to the first cam surface. Referring now to FIG. 7, the first cam surface 82 is at an oblique angle $\alpha$ relative to the longitudinal axis of the sear b. The angle of the first cam surface relative to the longitudinal axis of the sear is acute. The second surface 84 is at an oblique angle $\beta$ relative to the longitudinal axis b of the sear. The angle of the second surface 84 relative to the longitudinal axis of the sear is acute and smaller than the angle of the first cam surface relative to the sear axis.

Figure 8:
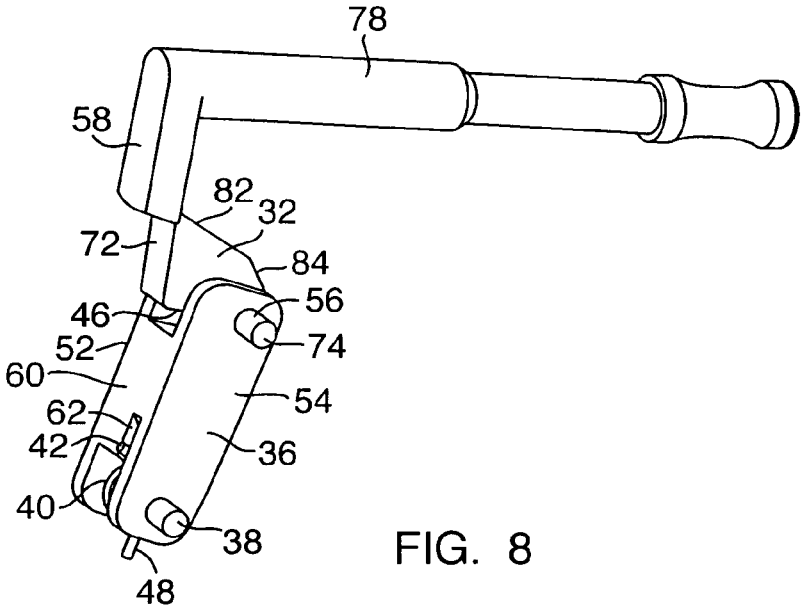
FIG. 8 is a perspective view of the sear and pivot arm of engaging the firing pin.

Referring now to FIG. 8, the first cam surface 82 is engaged with the radially extending leg 58 of the firing pin when the leg passes over the sear. The leg exerts a downward force on the first cam surface 82 causing the downward rearward arcuate movement of the sear about its pivot point relative to the pivot arm. This movement allows the leg of the striker to pass over the sear and return to a ready to fire position. This situation arises when manually chambering a round of ammunition or after a misfire.

The widths, or transverse dimensions, of the leg 58 and control edge 76 are preferably approximately the same to minimize fretting or scoring thereof by one part of the other. The vertical extent of the engagement or overlap of the two parts is sufficient to enable the sear to move the firing pin rearwardly to its fully cocked position before the sear is moved so that its sear surface disengages the leg causing the gun to be fired.

Referring now to FIG. 3, the trigger bar 30 is pivotably connected at one end to the trigger 28 by pin 86 fitted into a hole adjacent the forward end of the trigger bar. Also, adjacent its forward end, the trigger bar includes an upwardly extending finger portion or spur 90 and adjacent its after-end, an upwardly open U-shaped hook 92 defined by an upwardly extending disconnect arm 94 and a lip 96. The hook 92 serves to interengage with sear pin for moving the sear 32 rearward to cock and then release the firing pin 78 to fire the gun, as will hereinafter be more fully described.

The trigger of the present invention is urged forwardly in a similar fashion as the prior art trigger. The trigger 28 is urged forward by an expansion type coil spring that serves as the trigger spring secured at one end to a hole provided through a spring mounting arm which extends transversely of the trigger bar 30. The other end of the spring is fitted onto the pivot pin of the trigger. As the trigger is pivoted clockwise about the pivot pin, the trigger bar connected to the trigger by pin will move toward the rear of the gun. This motion will cause the coil spring to be expanded and tensioned to urge the trigger bar 30 forwardly for return to its forward position after each round is fired.

After the first round has been chambered by manually cycling the slide from its forward to its rearward position and which is returned to its forward position by a recoil spring, the firing mechanism will be in its ready to fire position.

As shown in FIG. 3, in its ready to be fired state, the control edge 76 of the sear will be fully engaged with the forward lower surface portion of the leg 58 of the firing pin. Although in this condition, firing pin spring may be slightly tensioned, the mechanism is in a "safe" condition because of the safety and cannot be fired unless the trigger is moved rearward to cause the firing pin to be cocked and released by the sear. When the trigger bar 30 is moved rearward, the pivot arm frame 36 is moved rearward about its pivot point in an arcuate path indicated by arrow c, compressing the sear spring. As depicted in FIG. 6, as the pivot arm is moved rearward, progressively less of the control edge of the sear is engaged with the leg of the firing pin until the control edge is no longer in contact with the leg and the firing pin is released and the gun is discharged.

After each round is fired, the slide will be moved rearward under the recoil force generated by expanding combustion gases. A cam surface or projection disposed on the underside surface of the slide, will engage and displace downwardly the upwardly extending disconnect arm 90 of the trigger bar. That downward movement will serve to disengage the hook 92 of the trigger bar from the sear pin 74, allowing its pivot arm frame 36 and the sear carried thereby to rotate toward its forward position under the force of the expanding sear spring 40. Such forward motion will allow the sear to be moved forwardly by spring 40 whereby the pivot arm frame 36 and sear will be returned to their initial, ready positions, with the sear ready to be reengaged by the leg 58 for the next cycle of operation.

Since the pistol embodying this invention has a semiautomatic action, the trigger will be allowed to be moved forwardly when released or with relaxed finger pressure to ready the firing mechanism to fire the next round. As shown in FIG. 3, the trigger spring will return the trigger and the interlinked trigger bar to their fully forward positions.

Although this invention has been shown and described with respect to an exemplary embodiment thereof, it should be understood by those skilled in the art that the foregoing and various other changes, omissions, and additions in the form and detail thereof may be made therein without departing from the spirit and scope of the invention.

What is claimed is:

1. A firing mechanism for a semi-automatic pistol having a frame, a slide reciprocally mounted on the frame, a barrel, a firing pin and a trigger, said firing mechanism comprising:

a housing mounted within the frame of the pistol;

a pivot arm assembly located within said housing, said pivot arm assembly having a pivot arm frame with laterally spaced side walls, an upper portion, a lower portion and an inner cavity disposed between said pivot arm frame side walls, said lower portion of the pivot arm frame being pivotally attached to said housing such that said pivot arm frame may selectively pivot about a pivot point in a substantially arcuate path between a forward position and a rearward position relative to the front and rear of the pistol, the pivot arm assembly also having a sear pivotally attached to the upper portion of said pivot arm frame, said sear selectively pivoting about a pivot point in a substantially arcuate path between a first position and a second position, and a spring mechanism operatively connected to said sear exerting a biasing force on the sear urging the sear toward said first position; and wherein the pivoting movement of said sear and pivot arm frame about their substantially arcuate paths does not result in said sear being displaced upward or downward, relative to the top and bottom of said pistol, in a substantially linear path.

2. The firing mechanism of claim 1 wherein said sear has adjacent first and second surfaces and a control edge that abuttingly engages the leg of the firing pin.

3. The firing mechanism of claim 2 wherein said first surface is at a first angle relative to a longitudinal axis of the sear and said second surface is at a second angle relative to a longitudinal axis of the sear, said first angle being greater than said second angle.

4. A firing mechanism for a semi-automatic pistol having a frame, a slide reciprocally mounted on the frame, a barrel, a firing pin and a trigger, said firing mechanism comprising:

a housing mounted within the frame of the pistol;

a pivot arm assembly located within said housing, said pivot arm assembly having a pivot arm frame with laterally spaced side walls, an upper portion, a lower portion and an inner cavity disposed between said pivot arm frame side walls, said lower portion of the pivot arm frame being pivotally attached to said housing such that said pivot arm frame may selectively pivot about a pivot point in a substantially arcuate path between a forward position and a rearward position relative to the front and rear of the pistol, the pivot arm assembly also having a sear pivotally attached to the upper portion of said pivot arm frame, said sear selectively pivoting about a pivot point in a substantially arcuate path between a first position and a second position, an actuation rod located in the inner cavity of the pivot arm frame, said actuation rod contacting a bottom surface of the sear and a spring mechanism operatively connected to said sear exerting a biasing force on the sear urging the sear toward said first position.

5. A firing mechanism for a semi-automatic pistol having a frame, a slide reciprocally mounted on the frame, a barrel, a firing pin and a trigger, said firing mechanism comprising:

a housing mounted within the frame of the pistol;

a pivot arm assembly located within said housing, said pivot arm assembly having a pivot arm frame with laterally spaced side walls, an upper portion, a lower portion and an inner cavity disposed between said pivot arm frame side walls, said lower portion of the pivot arm frame being pivotally attached to said housing such that said pivot arm frame may selectively pivot about a pivot point in a substantially arcuate path between a forward position and a rearward position relative to the front and rear of the pistol, the pivot arm assembly also having a sear pivotally attached to the upper portion of said pivot arm frame, said sear selectively pivoting about a pivot point in a substantially arcuate path between a first position and a second position, an actuation rod located in the inner cavity of the pivot arm frame, said actuation rod contacting a bottom surface of the sear, a spring mechanism operatively connected to said sear exerting a biasing force on the sear urging the sear toward said first position, and said spring mechanism includes a spring having a loop portion and two legs, one leg engages the housing and urges the pivot arm frame toward its forward position and opposes the direction of the trigger pull, the other leg biases the actuation rod against the sear urging the sear toward its first position.

6. The firing mechanism of claim 1 wherein said housing includes a stop disposed between the side walls to limit the arcuate pivoting movement of the pivot arm frame.

7. The firing mechanism of claim 1 wherein said pivot arm frame includes a stop to limit the arcuate pivoting movement of the sear.

8. A firing mechanism for a semi-automatic pistol having a frame, a slide reciprocally mounted on the frame, a barrel, a firing pin and a trigger, said firing mechanism comprising:

a housing mounted within the frame of the pistol;

a pivot arm assembly located within said housing which may be removed from said housing, said assembly including a pivot arm frame having laterally spaced side walls, an upper portion, a lower portion and an inner cavity disposed between said side walls, said lower portion of the pivot arm frame being pivotally attached to said housing such that said pivot arm frame may selectively pivot in a substantially arcuate path between a forward position and a rearward position relative to the front and rear of the pistol, the pivot arm assembly also includes a sear attached to the upper portion of said pivot arm frame, said sear having adjacent first and second surfaces and a control edge that abuttingly engages the leg of the firing pin, said first surface is at a first angle relative to a longitudinal axis of the sear and said second surface is at a second angle relative to the longitudinal axis of the sear, said first angle being greater than said second angle, and the assembly further includes a spring mechanism operatively connected to said sear exerting a biasing force on the sear; and wherein the pivoting movement of said sear and pivot arm frame about their substantially arcuate paths does not result in said sear being displaced upward or downward, relative to the top and bottom of said pistol, in a substantially linear path.

9. The firing mechanism of claim 8 wherein said sear is pivotally attached to the upper portion of said pivot arm frame, said sear selectively pivoting about a pivot point in a substantially arcuate path between a first position and a second position.

10. A firing mechanism for a semi-automatic pistol having a frame, a slide reciprocally mounted on the frame, a barrel, a firing pin and a trigger, said firing mechanism comprising:

a housing mounted within the frame of the pistol;

a pivot arm assembly located within said housing which may be removed from said housing, said assembly including a pivot arm frame having laterally spaced side walls, an upper portion, a lower portion and an inner cavity disposed between said side walls, said lower portion of the pivot arm frame being pivotally attached to said housing such that said pivot arm frame may selectively pivot in a substantially arcuate path between a forward position and a rearward position relative to the front and rear of the pistol, the pivot arm assembly also includes a sear attached to the upper portion of said pivot arm frame, said sear having adjacent first and second surfaces and a control edge that abuttingly engages the leg of the firing pin, said first surface is at a first angle relative to a longitudinal axis of the sear and said second surface is at a second angle relative to the longitudinal axis of the sear, said first angle being greater than said second angle, an actuation rod located in the inner cavity of the pivot arm frame, said actuation rod contacting a bottom surface of the sear and the assembly further includes a spring mechanism operatively connected to said sear exerting a biasing force on the sear.

11. A firing mechanism for a semi-automatic pistol having a frame, a slide reciprocally mounted on the frame, a barrel, a firing pin and a trigger, said firing mechanism comprising:

a housing mounted within the frame of the pistol;

a pivot arm assembly located within said housing which may be removed from said housing, said assembly including a pivot arm frame having laterally spaced side walls, an upper portion, a lower portion and an inner cavity disposed between said side walls, said lower portion of the pivot arm frame being pivotally attached to said housing such that said pivot arm frame may selectively pivot in a substantially arcuate path between a forward position and a rearward position relative to the front and rear of the pistol, the pivot arm assembly also includes a sear attached to the upper portion of said pivot arm frame, said sear having adjacent first and second surfaces and a control edge that abuttingly engages the leg of the firing pin, said first surface is at a first angle relative to a longitudinal axis of the sear and said second surface is at a second angle relative to the longitudinal axis of the sear, said first angle being greater than said second angle, an actuation rod located in the inner cavity of the pivot arm frame, said actuation rod contacting a bottom surface of the sear and the assembly further includes a spring mechanism operatively connected to said sear exerting a biasing force on the sear, said spring mechanism includes a spring having a loop portion and two legs, one leg engages the housing and urges the pivot arm frame toward its forward position and opposes the direction of the trigger pull, the other leg biases the actuation rod against the sear urging the sear toward its first position.

12. The firing mechanism of claim 8 wherein said housing includes a stop disposed between the side walls to limit the arcuate pivoting movement of the pivot arm frame.

13. The firing mechanism of claim 8 wherein said pivot arm frame includes a stop to limit the arcuate pivoting movement of the sear.

14. A semi-automatic pistol comprising:

a frame;

a barrel mounted on the frame;

a slide reciprocally mounted on the frame;

a trigger;

a firing pin; and a firing mechanism, said firing mechanism comprising a stationary housing mounted within the frame of the pistol, a pivot arm assembly located within said housing, the pivot arm assembly having a pivot arm frame with laterally spaced side walls, an upper portion, a lower portion and an inner cavity disposed between said side walls, said lower portion of the pivot arm frame being pivotally attached to said housing such that said pivot arm frame may selectively pivot about a pivot point in a substantially arcuate path between a forward position and a rearward position relative to the front and rear of the pistol, a sear pivotally attached to the upper portion of said pivot arm frame, said sear selectively pivoting about a pivot point in a substantially arcuate path between a first position and a second position, and a spring mechanism operatively connected to said sear exerting a biasing force on the sear holding the sear in said first position; and wherein said sear pivot point cannot be displaced upward or downward relative to the top and bottom of the pistol, independent of the arcuate path of the pivot arm frame, and wherein the arcuate path of said sear is not guided by a cam surface.

15. The semi-automatic pistol of claim 14 wherein said sear has adjacent first and second surfaces and a control edge that abuttingly engages the leg of the firing pin, said first surface is at a first angle relative to a longitudinal axis of the sear and said second surface is at a second angle relative to the longitudinal axis of the sear, said first angle being greater than said second angle.

16. A semi-automatic pistol comprising:

a frame;

a barrel mounted on the frame;

a slide reciprocally mounted on the frame;

a trigger;

a firing pin; and a firing mechanism, said firing mechanism comprising a stationary housing mounted within the frame of the pistol, a pivot arm assembly located within said housing, the pivot arm assembly having a pivot arm frame with laterally spaced side walls, an upper portion, a lower portion and an inner cavity disposed between said side walls, said lower portion of the pivot arm frame being pivotally attached to said housing such that said pivot arm frame may selectively pivot about a pivot point in a substantially arcuate path between a forward position and a rearward position relative to the front and rear of the pistol, a sear pivotally attached to the upper portion of said pivot arm frame, said sear selectively pivoting about a pivot point in a substantially arcuate path between a first position and a second position, an actuation rod located within the pivot arm frame, said actuation rod contacting a bottom surface of the sear and a spring mechanism operatively connected to said sear exerting a biasing force on the sear holding the sear in said first position.

17. A semi-automatic pistol comprising:

a frame;

a barrel mounted on the frame;

a slide reciprocally mounted on the frame;

a trigger;

a firing pin; and a firing mechanism, said firing mechanism comprising a stationary housing mounted within the frame of the pistol, a pivot arm assembly located within said housing, the pivot arm assembly having a pivot arm frame with laterally spaced side walls, an upper portion, a lower portion and an inner cavity disposed between said side walls, said lower portion of the pivot arm frame being pivotally attached to said housing such that said pivot arm frame may selectively pivot about a pivot point in a substantially arcuate path between a forward position and a rearward position relative to the front and rear of the pistol, a sear pivotally attached to the upper portion of said pivot arm frame, said sear selectively pivoting about a pivot point in a substantially arcuate path between a first position and a second position, an actuation rod located within the pivot arm frame, said actuation rod contacting a bottom surface of the sear and a spring mechanism operatively connected to said sear exerting a biasing force on the sear holding the sear in said first position, said spring mechanism includes a spring having a loop portion and two legs, one leg engages the housing and urges the pivot arm frame toward its forward position and opposes the direction of the trigger pull, the other leg biases the actuation rod against the sear urging the sear toward its first position.

18. A semi-automatic pistol comprising:

a frame;

a barrel mounted on the frame;

a slide reciprocally mounted on the frame;

a trigger;

a firing pin; and a firing mechanism, said firing mechanism comprising a housing mounted within the frame of the pistol, a pivot arm assembly located within said housing, the pivot arm assembly having a pivot arm frame with laterally spaced side walls, an upper portion, a lower portion and an inner cavity disposed between said side walls, said lower portion of the pivot arm frame being pivotally attached to said housing such that said pivot arm frame may selectively pivot about a pivot point in a substantially arcuate path between a forward position and a rearward position relative to the front and rear of the pistol, a sear attached to the upper portion of said pivot arm frame, said sear having adjacent first and second surfaces and a control edge that abuttingly engages the leg of the firing pin, said first surface is at a first angle relative to a longitudinal axis of the sear and said second surface is at a second angle relative to the longitudinal axis of the sear, said first angle being greater than said second angle, and a spring mechanism operatively connected to said sear exerting a biasing force on the sear; and wherein the pivoting movement of said sear and pivot arm frame about their substantially arcuate paths does not result in said sear being displaced upward or downward, relative to the top and bottom of said pistol, in a substantially linear path.

19. The semi-automatic pistol of claim 18 wherein said sear is pivotally attached to the upper portion of said pivot arm frame, said sear selectively pivoting about a pivot point in a substantially arcuate path between a first position and a second position.

20. A semi-automatic pistol comprising:

a frame;

a barrel mounted on the frame;

a slide reciprocally mounted on the frame;

a trigger;

a firing pin; and a firing mechanism, said firing mechanism comprising a housing mounted within the frame of the pistol, a pivot arm assembly located within said housing, the pivot arm assembly having a pivot arm frame with laterally spaced side walls, an upper portion, a lower portion and an inner cavity disposed between said side walls, said lower portion of the pivot arm frame being pivotally attached to said housing such that said pivot arm frame may selectively pivot about a pivot point in a substantially arcuate path between a forward position and a rearward position relative to the front and rear of the pistol, a sear attached to the upper portion of said pivot arm frame, said sear having adjacent first and second surfaces and a control edge that abuttingly engages the leg of the firing pin, said first surface is at a first angle relative to a longitudinal axis of the sear and said second surface is at a second angle relative to the longitudinal axis of the sear, said first angle being greater than said second angle, a spring mechanism operatively connected to said sear exerting a biasing force on the sear, and an actuation rod located within the pivot arm frame, said actuation rod contacting a bottom surface of the sear and the spring, said spring having a loop portion and two legs, one leg engaging the housing and urging the pivot arm frame toward its forward position and opposing the direction of the trigger pull, the other leg biasing the actuation rod against the sear urging the sear toward its first position.

* * * * *